US007665724B2

(12) United States Patent
Bingham et al.

(10) Patent No.: US 7,665,724 B2
(45) Date of Patent: Feb. 23, 2010

(54) KICKER

(75) Inventors: Jeffrey G. Bingham, Vancouver, WA (US); David F. D. Buck, Ridgefield, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 76 days.

(21) Appl. No.: 11/683,681

(22) Filed: Mar. 8, 2007

(65) Prior Publication Data

US 2008/0217839 A1 Sep. 11, 2008

(51) Int. Cl.
*B65H 3/52* (2006.01)

(52) U.S. Cl. ..... 271/121; 271/122; 271/124; 271/119; 271/118

(58) Field of Classification Search ..... 271/121, 271/118, 119, 122, 120, 124, 10.09
See application file for complete search history.

(56) References Cited

U.S. PATENT DOCUMENTS 4,526,358 A 7/1985 Ura et al.
5,029,839 A 7/1991 Kajiwara et al.
5,253,854 A * 10/1993 Tanoue et al. ..... 271/10.12
5,316,285 A * 5/1994 Olson et al. ..... 271/122
5,655,762 A 8/1997 Yergenson
5,718,425 A * 2/1998 Veigl ..... 271/121
5,882,004 A * 3/1999 Padget ..... 271/119
5,947,466 A 9/1999 Romine
6,199,855 B1 * 3/2001 Choeng et al. ..... 271/122
6,217,017 B1 * 4/2001 Yamazaki ..... 271/121
6,315,280 B1 * 11/2001 Jang ..... 271/9.02
6,874,778 B2 * 4/2005 Nakano et al. ..... 271/111
6,877,738 B2 * 4/2005 Sonoda et al. ..... 271/121
6,896,253 B2 * 5/2005 Hanabusa ..... 271/117
6,978,113 B2 * 12/2005 Kamimura et al. ..... 399/388
7,422,206 B2 * 9/2008 Okuda et al. ..... 271/121
7,484,724 B2 * 2/2009 Yamanaka et al. ..... 271/121
2002/0050680 A1 * 5/2002 Yanagi et al. ..... 271/121
2002/0175462 A1 * 11/2002 Sonoda et al. ..... 271/121
2007/0001376 A1 * 1/2007 Lim et al. ..... 271/121

OTHER PUBLICATIONS

HP LaserJet 5100 (2 photos) (believed to be commericially available as early as Mar. 8, 2006).

* cited by examiner

*Primary Examiner*—Patrick H Mackey
*Assistant Examiner*—Luis Gonzalez

(57) ABSTRACT

Various embodiments and methods relating to a kicker are disclosed.

25 Claims, 7 Drawing Sheets

KICKER

BACKGROUND

Picking individual sheets from a stack sometimes results in multiple sheets adhering to one another and being concurrently picked. Attempts to separate such sheets may result in damage to the sheets.

DETAILED DESCRIPTION OF THE EXAMPLE EMBODIMENTS

Figure 1:
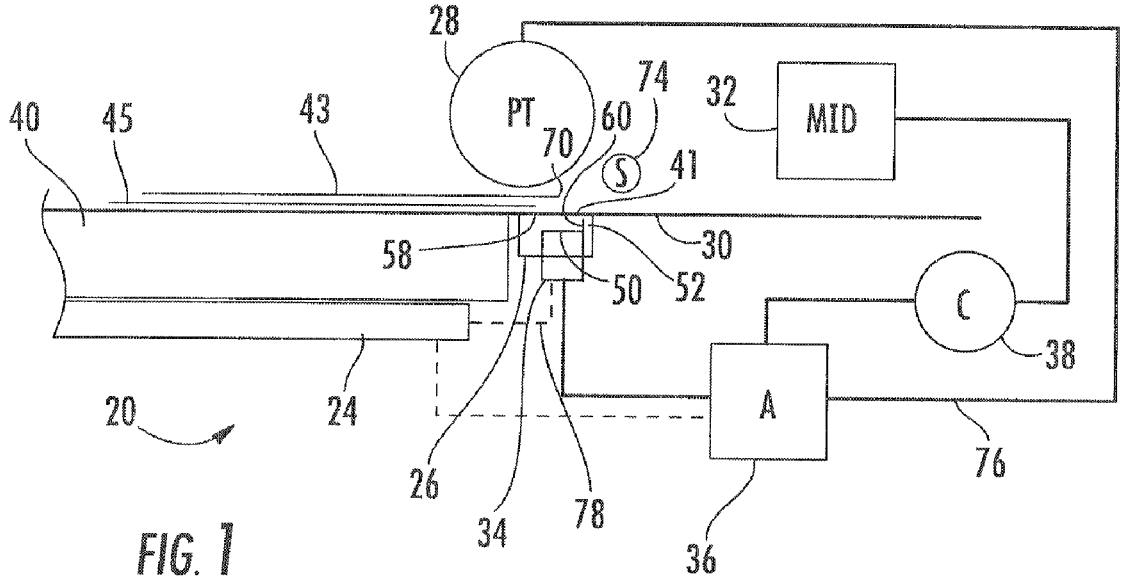
FIG. 1 is a side elevational view schematically illustrating a media interaction system with kickers in retracted positions according to an example embodiment.
Figure 2:
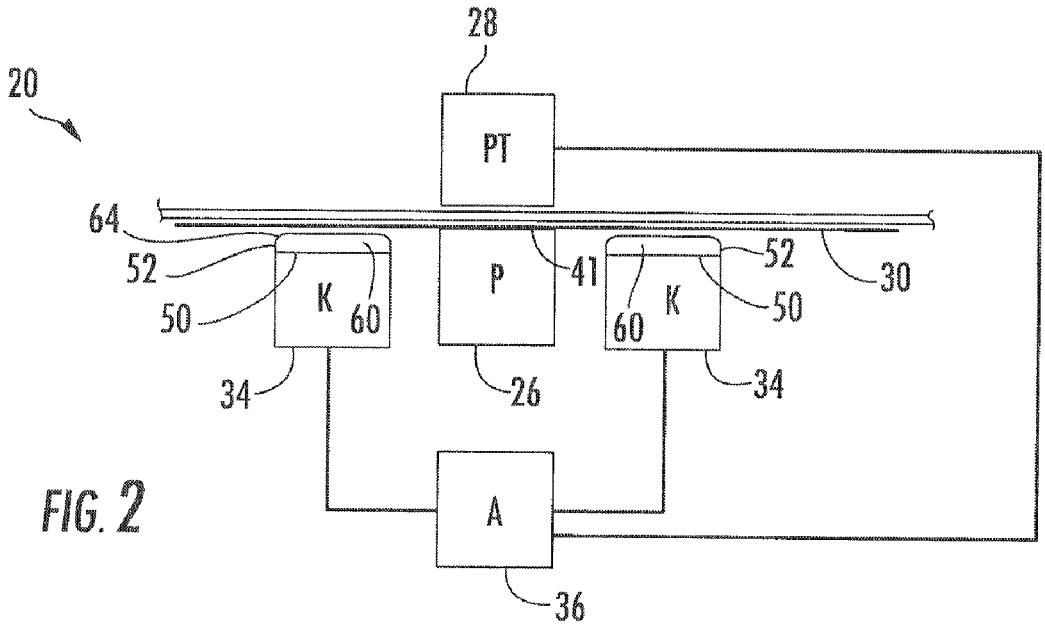
FIG. 2 is a front elevational view schematically illustrating the media interaction system of FIG. 1 according to an example embodiment.

FIGS. 1 and 2 schematically illustrate media interaction system 20 according to an example embodiment. Media interaction system 20 is configured to interact with sheets of media taken from a stack of media. As will be described hereafter, media interaction system 20 is configured to reduce the likelihood of multiple sheets being concurrently picked from a stack and being transported along a media path while potentially reducing damage to the sheets being picked.

As shown by FIG. 1, media interaction system 20 includes media input 24, separation pad 26, pick tire 28, media path 30, media interaction device 32, kickers 34 (two of which are shown in FIG. 2), actuator 36 and controller 38. Media input 24 comprises one or more structures configured to support and store sheets 40 of media in a stack prior to being picked by pick tire 28. In one embodiment, media input may comprise a tray. In another embodiment, media input 24 may comprise a bin or other similar structure. In particular embodiments, media input 24 may additionally include mechanisms, such as a lift plate, configured to lift or move the supported stack towards or away from the pick tire 28.

Separation pad 26 comprises one or more structures providing a surface 41 extending generally opposite to pick tire 28. Surface 41 is configured to assist in separating multiple sheets which may be temporarily adhered to one another. In the particular example illustrated, FIG. 1 illustrates a top most sheet 43 being picked from a stack of sheets 40 by pick tire 28. FIG. 1 further illustrates an underlying sheet 45 being concurrently picked by pick tire 28 as a result of sheet 45 adhering to sheet 43. In particular circumstances, sheet 43 may drag additional underlying sheets 45. Surface 41 is configured to have a coefficient of friction with the bottom of the underlying sheet 45 that is greater than the coefficient of friction between the bottom of sheet 43 and the top of sheet 45. As a result, separation pad 26 assists in separating sheets 43 and 45.

Pick tire 28 comprises a structure configured to frictionally engage a top of sheet 43 to drive sheet 43 from stack of sheets 40 towards media path 30 and towards media interaction device 32. In one embodiment, pick tire 28 comprises D-shaped roller. In another embodiment, pick tire 28 may comprise a cylindrical shaped roller. In yet other embodiments, pick tire 28 may comprise other mechanisms for frictionally engaging a top sheet of a stack and driving the sheet from the stack.

Media path 30 comprises an arrangement of panels, ribs, rollers or other structures configured to guide movement of sheets 40 from media input 24 to media interaction device 32. Although illustrated as linear, media path 30 may have a variety of different shapes depending upon the location of media interaction device 32 with respect to media input 24 and an output (not shown) of system 20.

Media interaction device 32 comprises one or more devices configured to interact with a sheet 40. In one embodiment, media interaction device 32 may be configured to form an image upon one or both sides of a sheet. For example, media interaction device 32 may comprise an ink jet printing device, an electrophotographic printing device, or other printing devices. In other embodiments, media interaction device 32 may be configured to sense or read information from one or both sides of a sheet 40. For example, in one embodiment, media interaction device 32 may comprise an optical scanning device. In still other embodiments, media interaction device 32 may comprise a device configured to crease, fold, staple, fasten or otherwise modify a sheet 40. In other embodiment, media interaction device 32 may be omitted, such in embodiments where sheets or media are just being singulated, such as in an automatic teller machine and the like.

Kickers 34 comprise structures configured to assist separation pad 26 in the separation of sheet 45 from sheet 43 during picking. Kickers 34 are movable between a retracted position (shown in FIGS. 1 and 2) in which kickers 34 are positioned substantially below separation pad 26 and media path 30 and an extended or sheet impeding position (shown in FIGS. 3 and 4). In the sheet impeding position, kickers 34 are configured to project into media path 30 so as to block or impede further movement of the underlying sheet 45 while the top most sheet 43 is continued to be driven along media path 30. In the example embodiment illustrated, kicker 34 additionally moves sheet 45 in a direction back towards the stack of sheets 40. In one embodiment, kicker 34 moves sheet 45 out of a nip formed between pick tire 28 and separation pad 26. In one embodiment, kickers 34 pivot between the retracted position and the impeding position. In another embodiment, kickers 34 linearly translate between the retracted position and the impeding position.

In the example embodiment illustrated, kickers 34 are symmetrically located with respect to separation pad 26 and pick tire 28. In the example illustrated, system 20 includes two kickers 34 on opposite sides of pick tire 28 and separation pad 26. Because kickers 34 are symmetrically located with respect to separation pad 26 and pick tire 28, kickers 34 are less likely to impart skew to sheets 40.

In the example illustrated, kickers 34 are located as close as feasible to separation pad 26 and pick tire 28. As a result, kickers 34 may more reliably contact leading edge 58 of sheet 45 and avoid engagement with sheet 43, in contrast to outer portions of such sheets distant from tire 28 where such portions may droop, arc or be more greatly skewed. In addition, kickers 34 may more reliably contact the leading edge 58 of different media types having different dimensions. For example, kickers 34 may more reliably engage leading edges of smaller media having smaller widths, such as photo media.

Although system 20 is illustrated as including a pair of kickers 34 on opposite sides of a single pick tire 28, in other embodiments system 20 may include greater than one pick tire 28 and greater than two kickers 34. For example, in another embodiment, system 20 may be provided with two pick tires 28. In one embodiment, two kickers 34 may be positioned about a first pick tire 28 while another two kickers 34 are positioned on opposite sides of a second pick tire 28. In another embodiment, two kickers 34 may be provided on opposite sides of the pair of pick tires 28 with the third pick tire sandwiched between and in close proximity to both the first pick tire and the second pick tire. In other embodiments, additional kickers 34 may be added without the addition of additional tires 28. In still other embodiments, system 20 may include a single kicker 34.

As shown by FIGS. 1 and 2, each kicker 34 includes a face 50 and a projection 52. Face 50 comprises a surface extending below projection 52 non-parallel to projection 52. Face 50 provides a surface configured to abut or contact the bottom of sheet 45 when kicker 34 is in the impeding position. As a result, face 50 frictionally engages the bottom of sheet 45 to retard movement of sheet 45 relative to face 50.

In one embodiment, face 50 is configured to extend tangential to pick tire 28 while being centered opposite to a rotational axis of pick tire 28 when in the impeding position. In other words, face 50 is configured to extend substantially perpendicular to the direction in which pick tire 28 applies a most force to sheets 43 and 45. As a result, the friction between face 50 and the bottom of sheet 45 is enhanced to enhance the ability of face 50 to retard further movement above sheet 45.

In one embodiment, face 50 is further formed from one or more materials having relatively high coefficient of friction with the bottom of sheet 45. For example, in one embodiment, face 50 may be formed from a resiliently compressible or soft material such as rubber, cork, resilient polymers and the like. In one embodiment, face 50 may additionally or alternatively be serrated or textured to enhance the coefficient of friction between face 50 and the bottom of sheet 45. In yet other embodiments, face 50 may be smooth and may omit a compressible or soft material distinct from a remainder of kicker 34. In other embodiments, face 50 may extend at other angles with respect to pick tire 28 or remain direction along which pick tire 28 applies the largest force to sheets 43 and 45.

Projection 52 comprises one or more ribs or other structures projecting above and beyond face 50 that provide an abutment surface 60 configured to abut or contact the leading edge 58 of sheet and 45 when kicker 34 is in the impeding position. As a result, kicker 34 more reliably inhibits further movement of sheet 45 to minimize the likelihood of multiple sheets being concurrently moved along media path 30. In one embodiment, abutment surface 60 extends at a positive angle up to and including 90 degrees with respect to face 50. In one embodiment, surface 60 extends substantially perpendicular to face 50. As a result, surface 60 securely engages the leading edge of sheet 45 with a reduced likelihood of the leading edge of sheet 45 sliding along and moving past projection 52. In particular embodiments, surface 60 may be formed with a material having an enhanced coefficient of friction with the leading edge 58 of sheet 45. In one embodiment, surface 60 may additionally or alternatively include dimples, serrations or other textures to enhance its coefficient of friction with the leading edge of sheet 45.

According to one embodiment, surface 60 projects at least about 0.5 mm above face 50 and less than or equal to about two mm above face 50. By extending at least 0.5 mm above face 50, surface 60 sufficiently engages leading edge 58 of sheet 45. By extending less than or equal to about two mm above face 50, less damage is imparted to sheets 40. In other embodiments, surface 60 may have other dimensions.

As will be described in more detail hereafter, kickers 34 are actuated from the retracted position to the impeding position after the top most sheet 43 has passed the raised location of projection 52. As a result, the bottom of sheet 43 engages a leading edge, a rear edge and corner edges of projection 52 as it is moved along by pick tire 28 or additional downstream rollers. According to one embodiment, the leading edge of projection 52 is sharp. This sharp edge assists in stripping the underlying sheet 45 from sheet 43. At the same time, the rear and corner edges of projection 52 are configured to reduce potential damage to sheet 43. In one embodiment, the rear and corner edges have a low coefficient of friction with the bottom of sheet 43. For example, the top side and the rear and corner edges of projection 52 are formed from one or more materials that have a lower coefficient of friction with the bottom of sheet 43 at compared to the materials of face 50. Because such edges have a lower coefficient of friction with sheet 43, sheet 43 is more easily advanced with a lower driving force being provided by pick tire 28. Such a lower driving force reduces the amount of torque that is supplied by a motor (not shown) and may reduce frictional adhering forces between sheets 43 and 45.

To further reduce the likelihood of damage to sheet 43 as it moves across the top and across the rear and corner edges of projection 52, the back side and corner edges of projection 52 have a reduced number of sharp edges or omit sharp edges projecting towards the bottom of sheet 43 which would otherwise mark, scratch or damage the bottom of sheet 43. For example, in one embodiment, corners 64 of projection 52 are rounded. In one embodiment, projection 52 also includes a rounded or arcuate back side opposite to surface 60 to also reduce the likelihood of damage to sheet 43 as it passes over projection 52. In other embodiments, such features may be omitted.

Figure 3:
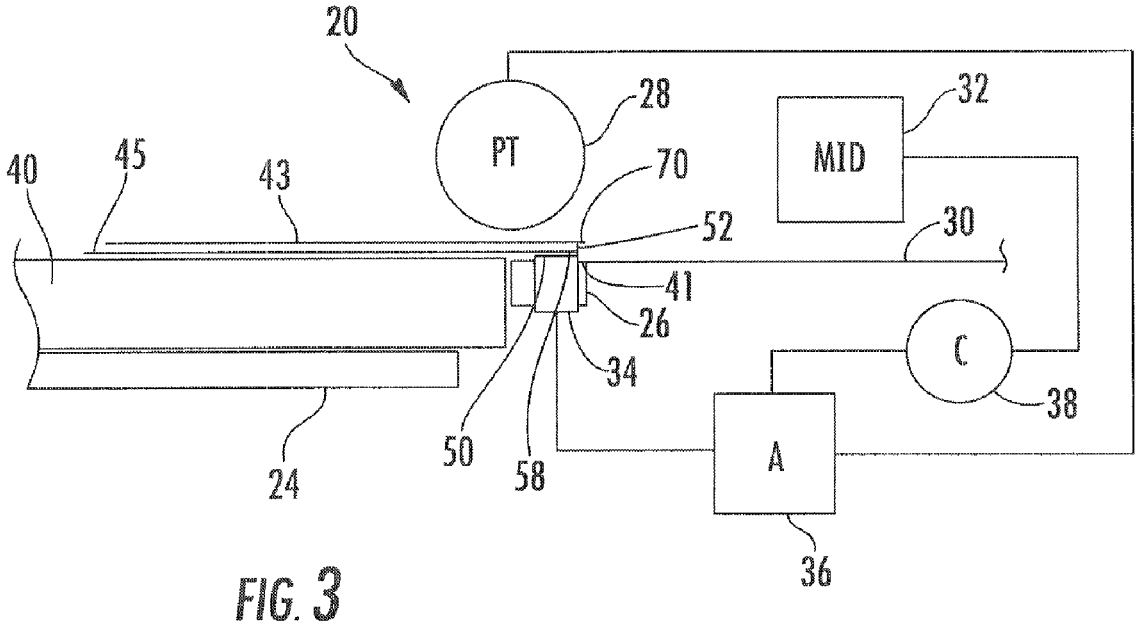
FIG. 3 is a side elevational view schematically illustrating the media interaction system of FIG. 1 which kickers in sheet impeding positions according to an example embodiment.
Figure 4:
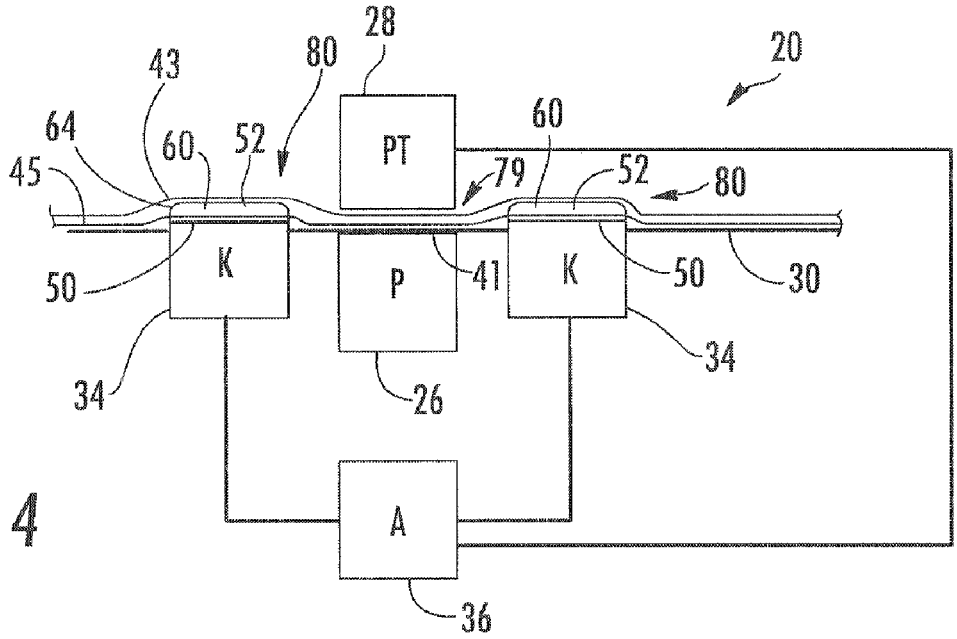
FIG. 4 is a front elevational view schematically illustrating the media interaction system of FIG. 3 according to an example embodiment.

Actuator 36 comprises a mechanism configured to actuate or move kickers 34 between the retracted position (shown in FIGS. 1 and 2) and the impeding position (shown in FIGS. 3 and 4). In particular, actuator 36 is configured to actuate kickers 34 from the retracted position to the impeding position when the leading edge 70 of the top most sheet 43 has been driven by pick tire 28 past the position at which projection 52 will be located when kicker 34 is in the impeding position. In other words, actuator 36 is configured to actuate kickers 34 from the retracted position to the impeding position when the leading edge 70 of sheet 43 has substantially passed separation pad 26 or pick tire 28.

In one embodiment, actuator 36 may comprise a motor and cam, a hydraulic or pneumatic cylinder or a solenoid. As shown in FIG. 1, in one embodiment, actuator 36 may additionally be coupled to pick tire 28 by a power train 76 (schematically shown) such that torque provided by a single motor drives both pick tire 28 and the movement of kickers 34.

Actuator 36 actuates kickers 34 in response to control signals from controller 38. In one embodiment, controller 38 may generate control signals directing actuator 36 to actuate kickers 34 based upon signals received from one or more sensors 74 that detect positioning of the leading edge 70 of sheet 43. Such sensors 74 may comprise optical sensors or other forms of sensors. In another embodiment, controller 38 may generate such control signals in a periodic time to fashion such that movement of kickers 34 cycles between the retracted position and the impeding position.

As shown in broken lines in FIG. 1, according to another embodiment, actuator 36 may alternatively be configured to actuate or move another component of system 20 which is physically or operably engaged or coupled to kickers 34 such that movement of the component by actuator 36 also actuates kickers 34 between the retracted position and the impeding position. Such movement of kickers 34 is in response to or based upon movement of other components of the system 20. For example, in one embodiment, media input 24 may include a lift plate (not shown) configured to lift the stack of sheets 40 into engagement with pick tire 28. Kickers 34 may be operably coupled to the lift plate (as indicated by broken line 78) such that movement of the lift plate results in responsive movement of kickers 34. For example, when the lift plate is in a lower position, kickers 34 are in the impeding position and when the lift plate is in a raised position, kickers 34 are in a retracted position. This arrangement may reduce the complexity and cost of system 20. In other embodiments, actuation of kickers 34 may be tied or directly responsive to movement of other components of system 20.

Controller 38 comprises one or more processing units configure to generate control signals directing the operation of media interaction device 32. Controller 38 may also be configured to generate control signals directing the operation of an actuator for actuating pick tire 28. In the example illustrated, the same actuator 36 used to actuate kickers 34 may be used to actuate pick tire 28. In other embodiments, a separate dedicated actuator may be used to drive pick tire 28. In the example illustrated, controller 38 further generates control signals directing actuator 36 to actuate kickers 34 based upon signals from sensors 74. As noted above, in other embodiments, the control of actuator 36 by controller 38 may be timed without input from a sensor, such as sensors 74, or may be omitted where actuator 36 is directly responsive to movement of one or more physical components of system 20, such as a lift plate associated with media input 24.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 38 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, controller 38 generates control signals directing pick tire 28 to initiate picking of the sheet 43 from the stack of sheets 40. When leading edge 70 of sheet 43 has moved past surface 60 of projection 52 as detected by sensors 74, controller 38 generates control signals directing actuator 36 to actuate kickers 34 to the impeding position shown in FIGS. 3 and 4. Alternatively, controller 38 may generate control signals directing actuator 36 to move another component of system 20, such as a lift plate associated with media input 24, wherein such movement causes kickers 34 to move to the impeding position shown in FIGS. 3 and 4 at a time when the leading edge 70 of sheet 43 has moved past the raised position of surface 60 of kickers 34.

FIGS. 3 and 4 illustrate kickers 34 in the impeding position after leading edge 70 of sheet 43 has moved past the raised position of projection 52. In the impeding position, kickers 34 project into media path 30 such that face 50 of each kickers 34 is elevated above surface 41 of separation pad 26 and may be in contact with the bottom of sheet 45. Surface 60 of projection 52 extends downstream of the leading edge 58 of sheet 45 to impede movement of sheet 45 beyond projection 52. At the same time, sheet 43 moves over projection 52 and is further driven by pick tire 28 along media path 30.

As shown by FIG. 4, pick tire 28 applies force to a central portion 79 of sheets 43 and 45 while kickers 34 apply an upward force to outer portions 80 of sheets 43 and 45. This results in sheets 43 and 45 having a general m-shaped profile. In the particular embodiment illustrated, kickers 34 are configured such that the resulting m-shaped profile that assists in the separation of sheet 45 from sheet 43 has reduced damage to sheets 43 and 45. In particular, kickers 34 project above the floor of media path 30 by distance just sufficient to the impede movement of sheet 45. In one embodiment, kickers 34 project a distance less than or equal to about 3 mm above the floor of media path 30. This reduces potential damage to sheets 43 and 45.

To further reduce potential damage to the sheets, kickers 34 have an enlarged width. In one embodiment, each of kickers 34 has a width of at least about 10 mm and nominally about 13.5 mm. This increased width distributes force across sheet 43, lessening the likelihood of a crease being formed in sheet 43. This increased width also reduces wear of projection 52, increasing the life of kickers 34. In other embodiments, the extent to which kickers 34 project into media path 30 and the dimensioning of each kicker 34 may be varied.

Figure 5:
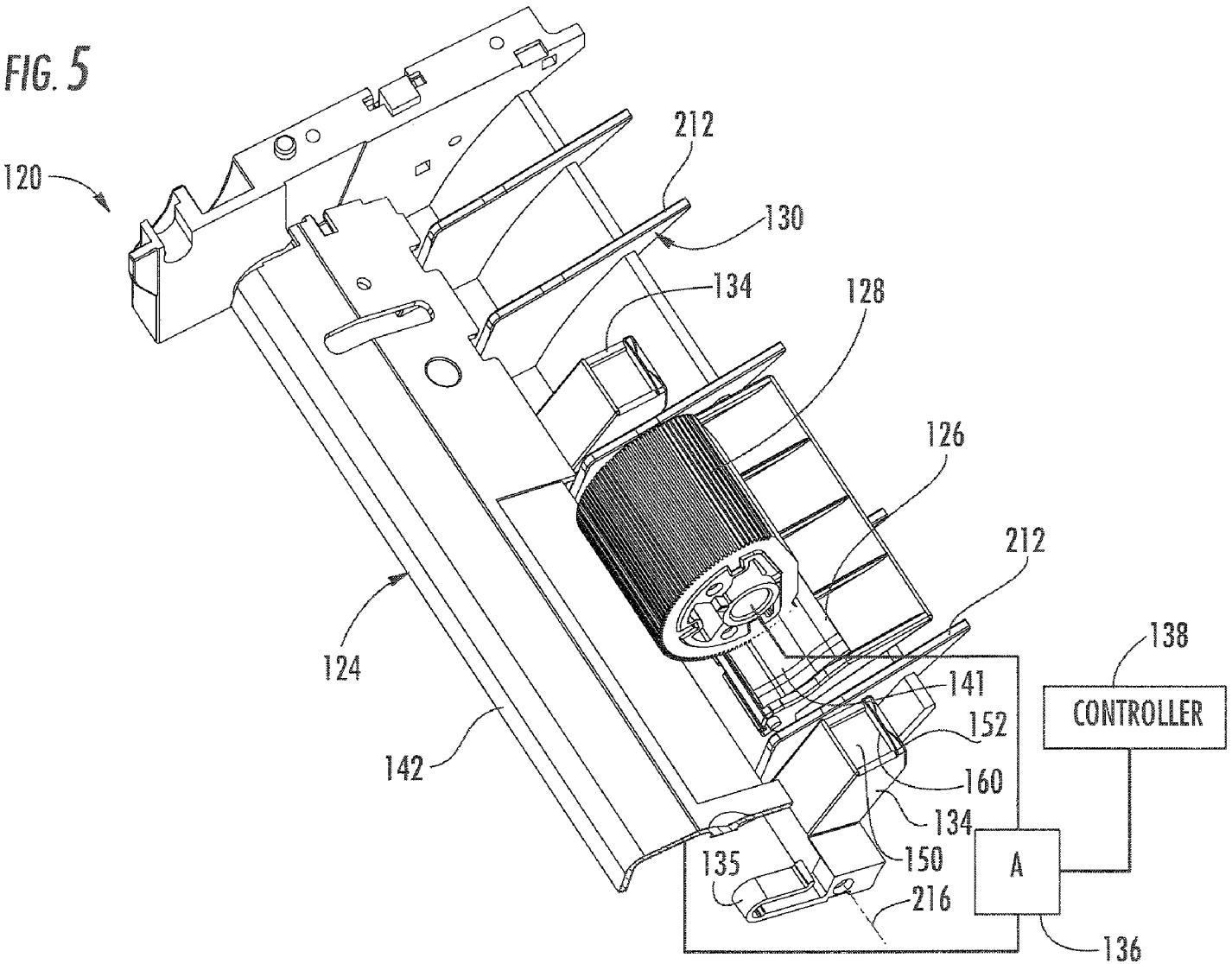
FIG. 5 is a top perspective view of another embodiment of the media interaction system of FIG. 1 according to an example embodiment.
Figure 6:
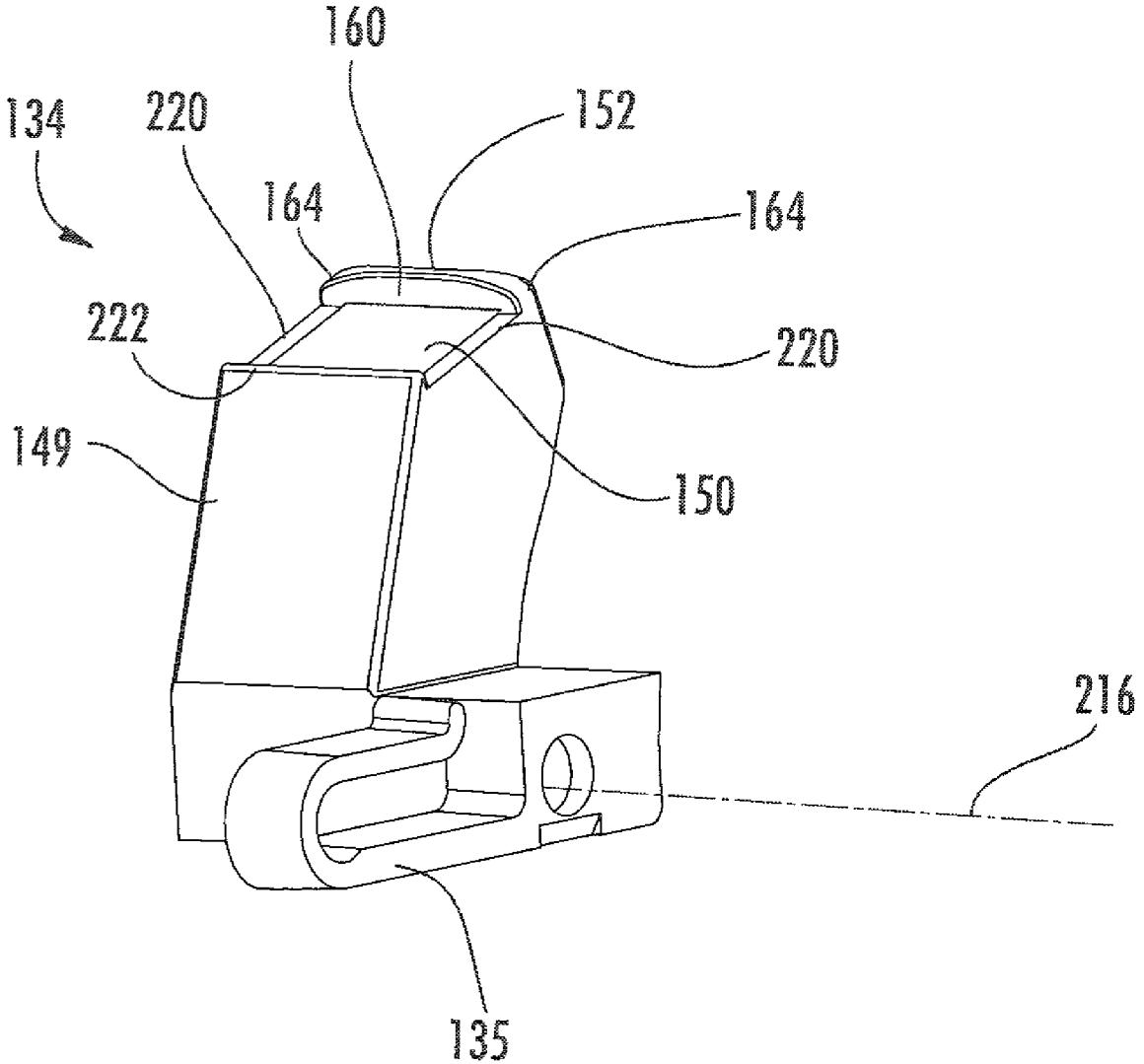
FIG. 6 is a perspective view of a kicker of the media interaction system of FIG. 5 according to an example embodiment.

FIGS. 5 and 6 illustrate media interaction system 120, another embodiment of media interaction system 20. Media interaction system 120 includes media input 124, separation pad 126, pick tire 128, media path 130, media interaction device 32 (shown and described with respect to FIG. 1), kickers 134 coupler 135, actuator 136 (schematically shown) and controller 138 (schematically shown). Media input 124, a portion of which is shown, comprises one or more structures configured to support and store sheets 140 (shown in FIGS. 7-9) of media in a stack prior to being picked by pick tire 128. In one embodiment, media input may comprise a tray. In another embodiment, media input 24 may comprise a bin or other similar structure. As shown by FIG. 5, media input 124 includes a lift plate 142, portions of which are broken away to illustrate coupler 135. Lift plate 142 is configured to be moved between a raised position in which lift plate 142 lifts the stack of sheets 140 into engagement with pick tire 128 and a lowered position. Lift plate 142 is further configured to engage coupler 135 when lowered to actuate kickers 134 to the impeding position. In other embodiments where other mechanisms are used to actuate kickers 134, lift plate 142 may have other configurations.

Figure 7:
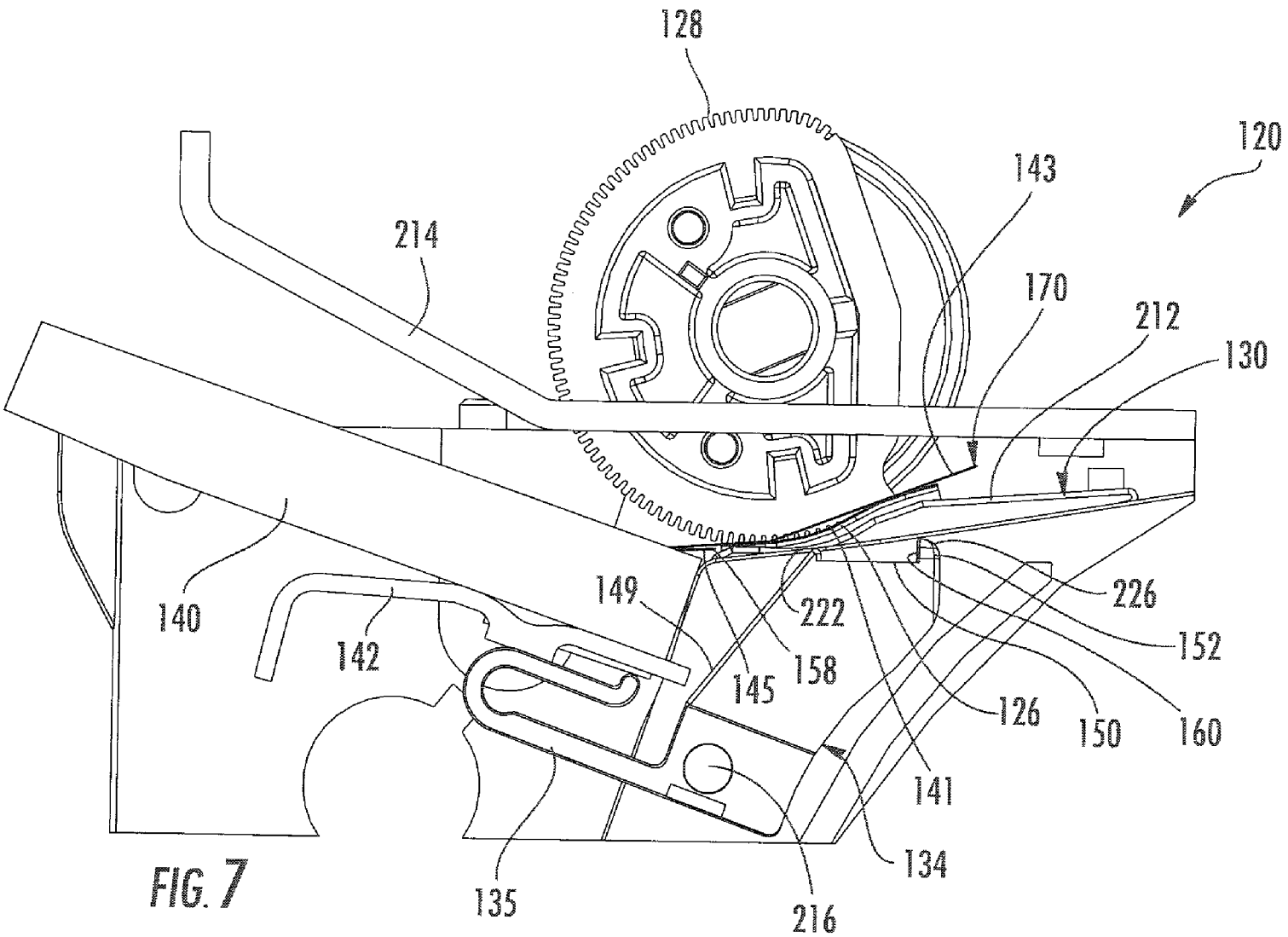
FIG. 7 is a side elevational view of the media interaction system of FIG. 5 illustrating kickers in a retracted position according to an example embodiment.

Separation pad 126 comprises one or more structures providing a surface 140 extending generally opposite to pick tire 128. Surface 140 is configured to assist in separating multiple sheets which may be temporarily adhered to one another. In the particular example illustrated, FIG. 7 illustrates a top most sheet 143 being picked from a stack of sheets 140 by pick tire 128. FIG. 1 further illustrates an underlying sheet 145 being concurrently picked by pick tire 128 as a result of sheet 145 frictionally adhering to sheet 143. Surface 140 is configured to have a coefficient of friction with the bottom of the underlying sheet 145 that is greater than the coefficient of friction between the bottom of sheet 143 and the top of sheet 145. As a result, separation pad 126 assists in separating sheets 143 and 145.

Pick tire 128 comprises a structure configured to frictionally engage a top of sheet 143 to drive sheet 143 from stack of sheets 140 towards media path 130 and towards media interaction device 32. In the embodiment illustrated, pick tire 128 comprises a cylindrical shaped roller. In other embodiments, pick tire 128 may comprise a D-shaped roller or other mechanisms for frictionally engaging a top sheet of a stack and driving the sheet from the stack.

Media path 130 comprises an arrangement of panels, ribs, rollers or other structures configured to guide movement of sheets 140 from media input 124 to media interaction device 32. In the embodiment illustrated, media path 130 includes a bottom or floor 212 and a ceiling plate 214 (shown in FIG. 7). As shown by FIG. 5, floor 212 is provided by plurality is spaced ribs, wherein pick tire 128 passes between adjacent ribs. In other embodiments, floor 212 may alternatively be provided by one or more plates having openings through which kickers 134 pass. Ceiling plate 214 extends above floor 212 and includes an opening through which pick tire 128 passes. In other embodiments, floor 212 and ceiling plate 214 may have other configurations. In some embodiments, one or both of floor 212 and ceiling plate 214 may be omitted.

Kickers 134 comprise structures configured to assist separation pad 126 in the separation of sheet 145 from sheet 143 (both of which are shown in FIG. 7) during picking. Kickers 134 are movable between a retracted position (shown in FIGS. 5 and 7) in which kickers 134 are positioned substantially below separation pad 26 and media path 30 and an extended or sheet impeding position (shown in FIGS. 8 and 9). In the sheet impeding position, kickers 134 are configured to project into media path 30 so as to block or impede further movement of one or more underlying sheets 145 while pick tire 128 continues to drive the top most sheet 143 along media path 130. In the example embodiment illustrated, kickers 134 additionally move sheet 145 in a direction back towards the stack of sheets 140. In one embodiment, kickers 134 move sheet 145 out of a nip formed between pick tire 128 and separation pad 126. In the embodiment illustrated, kickers 134 pivot about axis 216 between the retracted position and the impeding position. In another embodiment, kickers 134 may linearly translate between the retracted position and the impeding position.

In the example embodiment illustrated, kickers 134 are symmetrically located with respect to separation pad 126 and pick tire 128. In the example illustrated, system 120 includes two kickers 134 on opposite sides of pick tire 128 and separation pad 126. Because kickers 134 are symmetrically located with respect to separation pad 126 and pick tire 128, kickers 134 are less likely to impart skew to sheets 140. In the example illustrated, kickers 134 are located as close as feasible to separation pad 126 and pick tire 128. As a result, kickers 134 may more reliably contact leading edge 158 of sheet 145 and avoid engagement with sheet 143, in contrast other embodiments where kickers 134 may be located to engage outer portions of such sheets distant from tire 128 where such portions may droop, arc or be more greatly skewed. In addition, kickers 134 may more reliably contact the leading edge 158 of different media types having different dimensions. For example, kickers 134 may more reliably engage leading edges of smaller media having smaller widths, such as photo media.

Although system 120 is illustrated as including a pair of kickers 134 on opposite sides of a single pick tire 128, in other embodiments, system 120 may include greater than one pick tire 128 and greater than two kickers 134. For example, in another embodiment, system 120 may be provided with two pick tires 128. In one embodiment, two kickers 134 may be positioned about a first pick tire 128 while another two kickers 134 are positioned on opposite sides of a second pick tire 128. In another embodiment, two kickers 134 may be provided on opposite sides of the pair of pick tires 128 with the third pick tire sandwiched between and in close proximity to both the first pick tire and the second pick tire. In other embodiments, additional kickers 134 may be added without the addition of additional tires 128.

FIG. 6 illustrates an individual kicker 134. As shown by FIG. 6, each kicker 134 includes a first face 149, a second face 150 and a projection 152. Face 149 extends from a lower portion of kicker 134 to face 150. Face 149 is configured to engage additional underlying sheets 140 which may have been dragged by the top most sheet 143 as kicker 134 pivots towards its final impeding position or location. Face 149 extends oblique to face 150. As a result, face 149 gradually transitions any engaged sheet towards face 150 and projection 152. In other embodiments, face 149 may have other configurations.

Face 150 comprises a surface extending below projection 152 non-parallel to projection 152. Face 150 provides a surface configured to abut or contact the bottom of sheet 145 when kicker 134 is in the impeding position. As a result, face 510 frictionally engages the bottom of sheet 45 to retard movement of sheet 145 relative to face 150.

Figure 8:
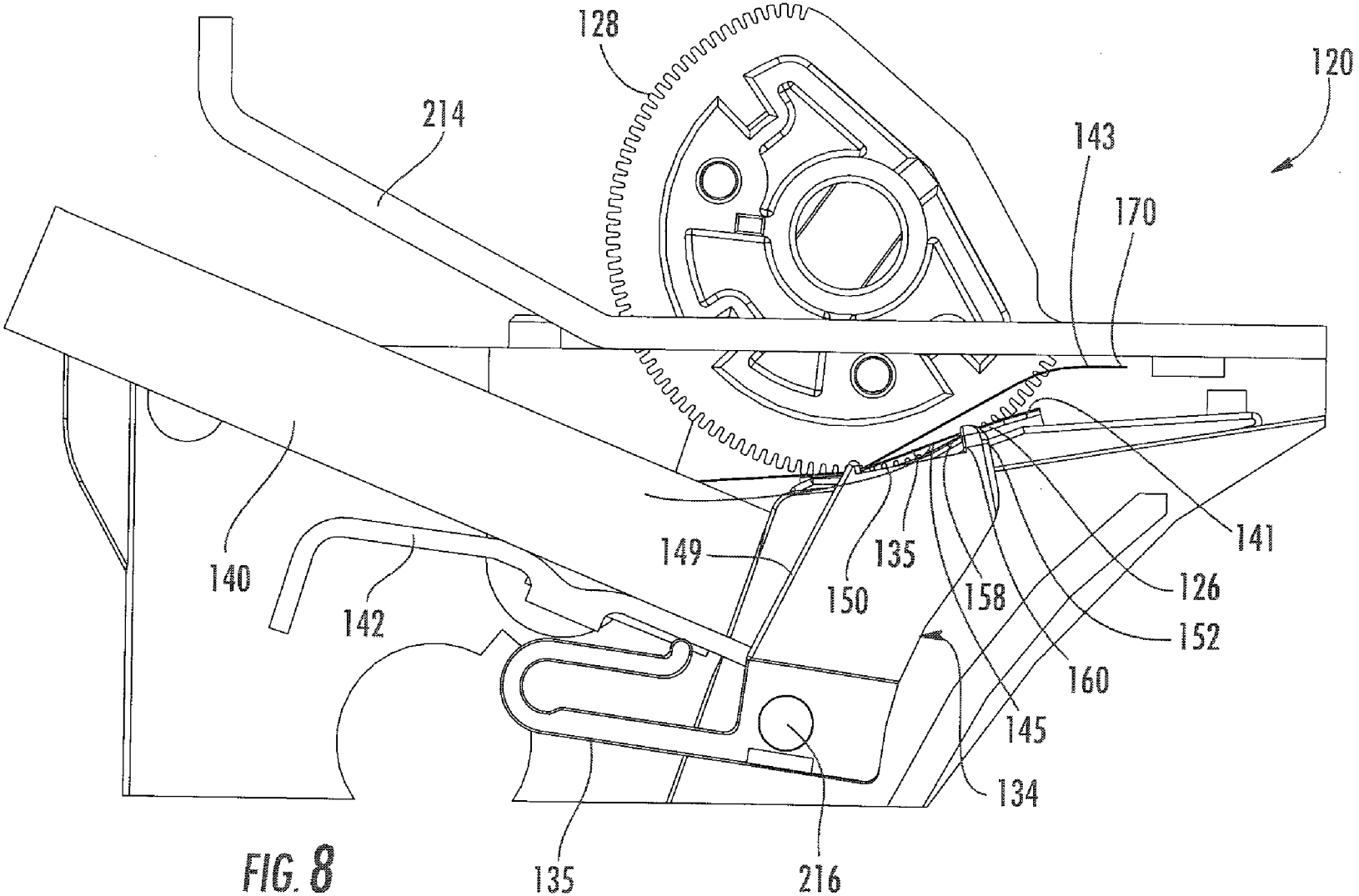
FIG. 8 is a side elevational view of the media interaction system of FIG. 5 illustrating initial actuation of the kickers to an impeding position according to an example embodiment.

In one embodiment, face 50 is configured to extend tangential to pick tire 128 while being centered opposite to a rotational axis of pick tire 128 when in the impeding position. In other words, face 150 is configured to extend substantially perpendicular to the direction in which pick tire 128 applies the largest amount of force to sheets 143 and 145 as shown in FIG. 8. As a result, the friction between face 150 and the bottom of sheet 145 is enhanced to enhance the ability of face 150 to retard further movement above sheet 145.

In the embodiment illustrated, face 150 is further formed from one or more materials having relatively high coefficient of friction with the bottom of sheet 145. For example, in the embodiment illustrated, face 50 is formed from a cavity filled with a resiliently compressible or soft material such as rubber, cork, resilient polymers and the like. The cavity is bordered by four walls including two sidewalls 220 and a rear wall 222 opposite to projection 152. Rear wall 222 projects above sidewalls 220 above face 150 to protect face 150 from being peeled or otherwise separated from a remainder of kicker 134. In other embodiments, face 150 may comprise a pad of material adhered or otherwise secured to a remainder of kicker 134. In still other embodiments, face 150 may additionally or alternatively be serrated or textured to enhance the coefficient of friction between face 150 and the bottom of sheet 145. In yet other embodiments, face 150 may be smooth and may omit a compressible or soft material distinct from a remainder of kicker 134. In other embodiments, face 150 may extend at other angles with respect to pick tire 128 or remain direction along which pick tire 128 applies the largest force to sheets 143 and 145.

Projection 152 comprises one or more ribs or other structures projecting above and beyond face 150 that provide an abutment surface 160 configured to abut or contact the leading edge 58 of sheet and 45 when kicker 34 is in the impeding position. As a result, kicker 134 more reliably inhibits further movement of sheet 145 to minimize the likelihood of multiple sheets being concurrently moved along media path 130. In one embodiment, abutment surface 160 extends at a positive angle up to and including 90 degrees with respect to face 150. In one embodiment, surface 160 extends from about 45 degrees to about 90 degrees with respect to face 150. In one embodiment, surface 60 extends substantially perpendicular to face 150. As a result, surface 160 securely engages the leading edge of sheet 145 with a reduced likelihood of the leading edge of sheet 145 sliding along and moving past projection 152. In particular embodiments, surface 160 may be formed with a material having an enhanced coefficient of friction with the leading edge 158 of sheet 145. In one embodiment, surface 160 may additionally or alternatively include dimples, serrations or other textures to enhance its coefficient of friction with the leading edge of sheet 145.

According to one embodiment, surface 160 projects at least about 0.5 mm above face 150 and less than or equal to about two mm above face 150. By extending at least 0.5 mm above face 150, surface 160 sufficiently engages leading edge 158 of sheet 145. By extending less than or equal to about two mm above face 150, less damage is imparted to sheets 140. In other embodiments, surface 160 may have other dimensions.

In one embodiment, projection 52 is resiliently flexible or compliant with respect to face 50 so as to deform marginally with a sheet upon being contacted by a sheet. For example, in one embodiment, projection 52 may be formed from a resiliently flexible material, such as rubber or a resiliently flexible polymer, and may be dimensioned to resiliently flex when being contacted by a sheet. In one embodiment, projection 52 may comprise a resiliently flexible thin blade. Because projection 52 is resiliently flexible or compliant, bends imparted to sheet 43 by projection 52 are reduced while projection 52 maintains a seal with the bottom of sheet 45. In other embodiments, projection 52 may alternatively be rigid with respect to a remainder of kicker 34.

Like kickers 34 described above, kickers 134 are actuated from the retracted position to the impeding position after the top most sheet 143 has passed the raised location of projection 152. As a result, the bottom of sheet 143 engages a top and edges of projection 152 as it is moved along by pick tire 128 or additional downstream rollers. In the embodiment illustrated, the top and/or edges of projection 152 are configured to have a low coefficient of friction with the bottom of sheet 143. For example, the top and side edges of projection 152 are formed from one or more materials that have a lower coefficient of friction with the bottom of sheet 143 at compared to the materials of face 150. Because such edges have a lower coefficient of friction with sheet 143, sheet 143 is more easily advanced with a lower driving force being provided by pick tire 128. Such a lower driving force reduces the amount of torque that is supplied by a motor (not shown) and may reduce frictional adhering forces between sheets 143 and 145.

To further reduce the likelihood of damage to sheet 143 as it moves across the top and across the edges a projection 152, the top and edges of projection 152 and reduce or omit sharp edges projecting towards the bottom of sheet 143 which would otherwise mark, scratch or damage the bottom of sheet 143. For example, in one embodiment, corners 164 of projection 152 are rounded. In one embodiment, projection 152 also includes a rounded or arcuate back side 226 (shown in FIG. 7) opposite to surface 60 to also reduce the likelihood of damage to sheet 143 as it passes over projection 152. In other embodiments, such features may be omitted.

Coupler 135, also shown in FIG. 6, comprises a mechanism extending between kicker 134 and lift plates 142 that is configured to transfer motion from lift plate 142 to kicker 134 to pivot kicker 134 about axis 216 between the retracted and the impeding positions. In the example illustrated, coupler 135 comprises a spring extending from kicker 134 to a position opposite to and below lift plate 142. As a result, as lift plate 142 is lowered, coupler 135 is initially compressed and subsequently moved to pivot kicker 134 about axis 216 from a retracted position to the impeding position. In other embodiments, coupler 135 may alternatively comprise a physical extension extending from kicker 134 or may comprise a cam or other structure connected to kicker 134.

As shown by FIG. 6, in the example illustrated, coupler 135 is integrally formed as a single unitary body with kicker 134, reducing part count and complexity. In one embodiment, kicker 134 (excluding a material of face 150) and coupler 135 are integrally formed as a single unitary body from a polycarbonate material. In other embodiments, kicker 134 and coupler 135 may be formed from other materials. In other embodiments, coupler 135 may alternatively be fastened, welded, bonded or otherwise connected to kicker 134

As shown by FIG. 7, actuator 136 comprises one or more mechanisms operably coupled to lift plate 142 and configured to actuate or move lift plate 142 which is physically or operably engaged or coupled to kickers 134 by coupler 135 such that movement of this plate 142 actuator 136 also actuates kickers 134 between the retracted position and the impeding position. Such movement of kickers 134 is in response to or based upon movement of lift plate 142.

Controller 138 comprises one or more processing units configure to generate control signals directing the operation of at least actuator 136. In the particular example illustrated, controller 138 generates control signals directing actuator 136 to drive both pick tire 128 and lift plate 142 in a timed and controlled fashion. As noted above, movement of this plate 142 also actuates kickers 134 between the retracted and impeding positions. In other embodiments, separate actuators and 136 may provide for pick tire 128 and lift plate 142.

Figure 9:
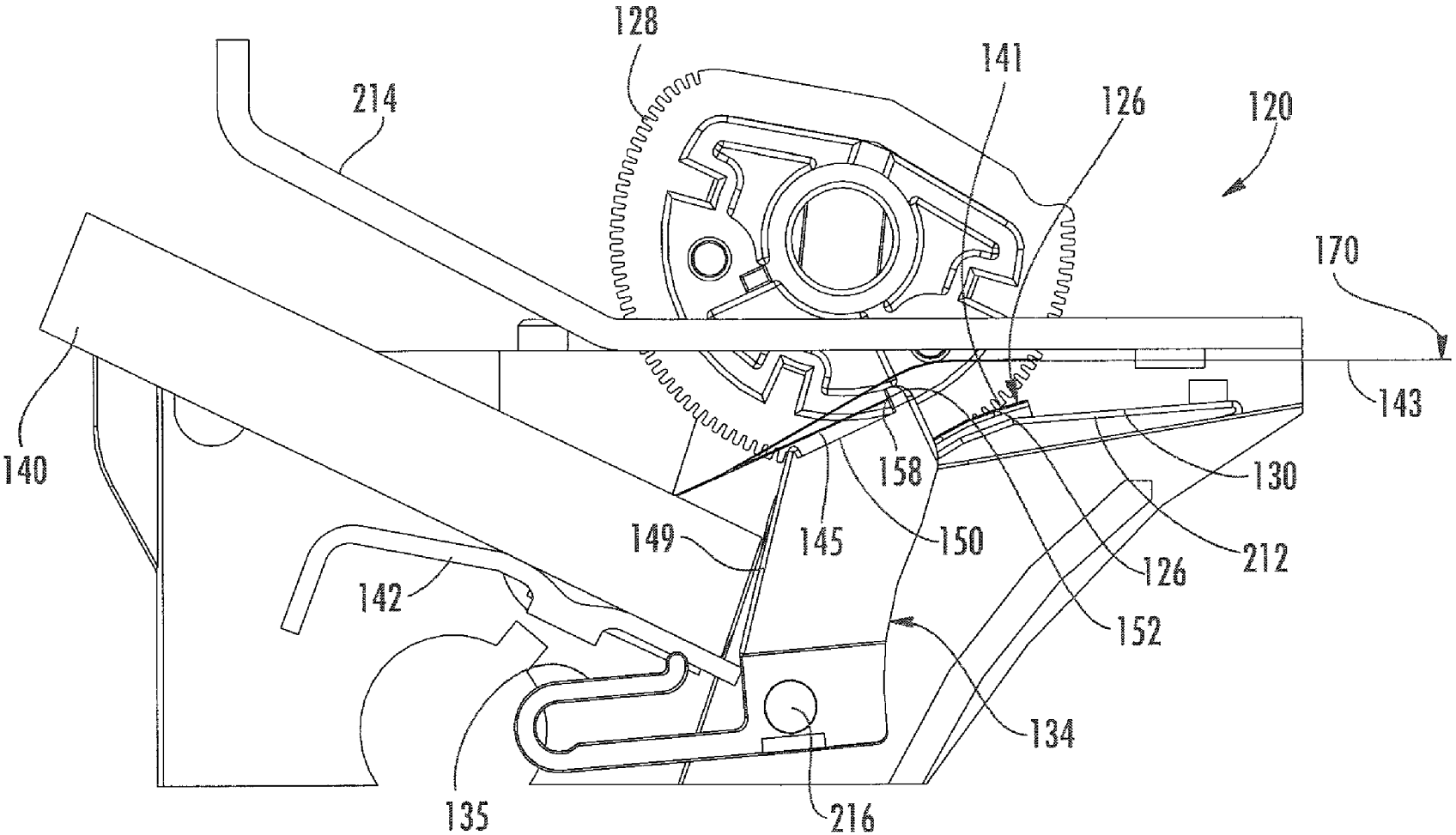
FIG. 9 is a side elevational view of the media interaction system of FIG. 5 illustrating further movement of the kickers while in the impeding position according to an example embodiment.

FIGS. 7-9 illustrate an example sheet picking operation of the system 120. FIG. 7 illustrates pick tire 128 and kickers 134 just prior to activation of kickers 134. In the state shown by FIG. 7, controller 138 has generated control signals directing actuator 136 to raise lift plate 142 to the raised position and has further generated control signals directing actuator 136 to drive pick tire 128 to pick the topmost sheet 143 from the stack of sheets 140. As shown by FIG. 7, sheet 143 is dragging an underlying sheet 145 as a result of friction between such sheets. Although a single sheet 145 is illustrated, in circumstances, additional underlying sheets may also be dragged along with sheet 143. As further shown by FIG. 7, the leading edge 170 of sheet 143 is urged ahead of the leading edge 158 of the underlying sheets 145. At the moment of time shown in FIG. 7, the leading edge 170 of sheet 143 has just moved past separation pad 126 and also past the position in which projection 152 will extend above media path 130 when kicker 134 is in the initial impeding position.

FIG. 8 illustrates system 120 at a later time during the picking operation, wherein lift plate 142 has been lowered. As a result, lift plate 142 exerts a downward force against coupler 135 which pivots kickers 134 about axis 216 such that face 150 and projection 152 both extend above media path 130. As shown by FIG. 8, surface 160 of projection 152 engages leading edge 158 of the one or more underlying sheets 145 while the topmost sheet 143 continues to move along media path 130. In the embodiment illustrated in which face 150 is compressible and has a higher coefficient of friction with respect to the bottom of sheet 145, face 150 retards movement of the underlying sheet 145. Surface 160 also retards or impedes movement of the underlying sheet or sheets 145.

FIG. 9 illustrates completion of the pick operation system 120. As shown by FIG. 9, lift plate 142 is lowered even further, pivoting kicker 134 about axis 216 to a greater extent to lift face 150 and projection 152 to a greater extent above separation pad 126 and the floor 212 of media path 130. During such movement, surface 160 drives or move the underlying sheet or sheets 145 back towards the stack of sheets 140 and elevates the underlying sheets 145 above separation pad 126. In other embodiments, surface 160 may alternatively merely block further movement of the underlying sheet or sheets 145 without moving such sheets in reverse direction. While projection 152 is impeding further movement of sheet 145, the topmost sheet 143 is continued to be driven over projection 152 and along media path 130. As a result, kickers 134 reduce the likelihood of multiple sheets concurrently moving along media path 130. This process is repeated for each sheet to be picked.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a pick tire;

a pad opposite the pick tire;

a first kicker having a first face and a first projection extending beyond the first face, wherein the first kicker is configured to move between a first position in which the first projection engages a leading edge of a sheet while a bottom of the sheet extends across the first face and a second position retracted below the pad; and a second kicker on an opposite side of the pick tire having a second face and a second projection extending beyond the second face, wherein the second kicker is configured to move between a first position in which the second face extends above the pad tangential to the pick tire such that the second projection engages a leading edge of a sheet extending across the second face and a second position retracted below the pad, wherein the first face is resiliently compressible and is formed by a material different than a remainder of the first kicker, wherein the first kicker includes a cavity filled with the material.

2. The apparatus of claim 1, wherein the first kicker pivots between the first position and the second position.

3. The apparatus of claim 1, wherein the first kicker is configured to pivot to the first position in response to a leading edge of a second sheet moving past the pick tire.

4. The apparatus of claim 1, wherein the first projection includes rounded side corners.

5. The apparatus of claim 1, wherein the first projection has a sharp leading edge.

6. The apparatus of claim 1, wherein the first projection is resiliently flexible.

7. The apparatus of claim 1 further comprising a lift plate configured to lift a stack of media towards the pick tire, wherein the first kicker is operably coupled to the lift plate to move between the first position and the second position in response to movement of the lift plate.

8. The apparatus of claim 7 further comprising a spring coupled between the lift plate and the first kicker.

9. The apparatus of claim 1 further comprising an actuator configured to actuate the first kicker between the first position and the second position.

10. The apparatus of claim 1, wherein the first projection extends at least 0.5 mm above the face.

11. The apparatus of claim 10, wherein the first projection extends less than or equal to about 2 mm above the first face.

12. The apparatus of claim 1, wherein the first projection extends substantially perpendicular to the first face.

13. The apparatus of claim 1 further comprising a third face extending oblique to the first face, the third face configured to engage a leading edge of the sheet prior to the first projection engaging the leading edge of the sheet.

14. The apparatus of claim 1, wherein the first kicker and the second kicker are symmetrically positioned with respect to the pick tire.

15. The apparatus of claim 1, wherein the first face extends at least about 3 mm above the pad when the kicker is in a first position.

16. An apparatus comprising:

a kicker having a first compressible face and a first projection extending beyond the first face, wherein the first projection extends substantially perpendicular to the first face and wherein the kicker is configured to move between a first position in which the first projection engages a leading edge of a sheet while a bottom of the sheet extends across the first face and a second position retracted below a pad opposite a pick tire; and a spring integrally formed as a single unitary body with the kicker and configured to be compressed as the kicker moves from the second position to the first position.

17. An apparatus comprising:

a pick tire;

a pad opposite the pick tire;

a kicker having a first face and a first projection extending beyond the first face, wherein the kicker is configured to move between a first position in which the first projection engages a leading edge of a sheet while a bottom of the sheet extends across the first face and a second position retracted below the pad;

a lift plate configured to lift a stack of media towards the pick tire, wherein the kicker is operably coupled to the lift plate to move between the first position and the second position in response to movement of the lift plate; and a spring coupled between the lift plate and the kicker so as to pivot with the kicker after being compressed by movement of the lift plate.

18. An apparatus comprising:

a pick tire;

a pad opposite the pick tire; and a first kicker having a first face and a first projection extending substantially perpendicular to and beyond the first face, wherein the first kicker is configured to move between a first position in which the first projection engages a leading edge of a sheet while a bottom of the sheet extends across the first face and a second position retracted below the pad, when the first projection extends less than or equal to about 2 mm above the first face.

19. The apparatus of claim 18, wherein the first projection has a sharp leading edge.

20. The apparatus of claim 18, wherein the first projection is resiliently flexible.

21. The apparatus of claim 18 further comprising a lift plate configured to lift a stack of media towards the pick tire, wherein the first kicker is operably coupled to the lift plate to move between the first position and the second position in response to movement of the lift plate.

22. The apparatus of claim 21 further comprising a spring coupled between the lift plate and the first kicker so as to pivot with the kicker after being compressed by movement of the lift plate.

23. The apparatus of claim 1, wherein the material is selected from a group of materials consisting of rubber, cork and resilient polymers.

24. An apparatus comprising:

a pick tire;

a pad opposite the pick tire;

a first kicker having a first face and a first projection extending beyond the first face, wherein the first kicker is configured to move between a first position in which the first projection engages a leading edge of a sheet while a bottom of the sheet extends across the first face and a second position retracted below the pad; and a second kicker on an opposite side of the pick tire having a second face and a second projection extending beyond the second face, wherein the second kicker is configured to move between a first position in which the second face extends above the pad tangential to the pick tire such that the second projection engages a leading edge of a sheet extending across the second face and a second position retracted below the pad, wherein the first face is resiliently compressible and is formed by a material different than a remainder of the first kicker, wherein the first projection extends at least 0.5 mm above the face.

25. The apparatus of claim 24, wherein the first projection extends less than or equal to about 2 mm above the first face.

* * * * *